US005427240A

United States Patent [19]

Holtkamp, Jr.

[11] Patent Number: 5,427,240

[45] Date of Patent: Jun. 27, 1995

[54] SHIPPING BOX FOR PLANTS

[75] Inventor: Reinhold Holtkamp, Jr., Nashville, Tenn.

[73] Assignee: Holtkamp Greenhouse, Inc., Nashville, Tenn.

[21] Appl. No.: 231,737

[22] Filed: Apr. 25, 1994

[51] Int. Cl.[6] ..... B65D 85/52; A01G 9/02

[52] U.S. Cl. ..... 206/423; 47/84; 206/478; 206/805; 229/120.38

[58] Field of Search ..... 206/423, 805, 526, 478; 47/84; 229/120.02, 120.03, 120.38

[56] References Cited

U.S. PATENT DOCUMENTS

| | | | |
|---|---|---|---|
| 1,842,072 | 1/1932 | Collingbourne | 206/478 |
| 2,021,070 | 11/1935 | Levine | 206/478 X |
| 2,226,409 | 12/1940 | Patterson et al. | 206/478 |
| 2,270,702 | 1/1942 | Getmansky | 206/478 X |
| 2,661,574 | 12/1953 | Ritter | 47/84 |
| 3,028,005 | 4/1962 | Shaffer | 206/423 |
| 3,048,318 | 8/1962 | Sabin | 229/120.38 |
| 4,170,301 | 10/1979 | Jones et al. | 206/423 |
| 4,508,223 | 4/1985 | Catrambone | 206/423 |
| 5,038,930 | 8/1991 | Holtkamp, Jr. | 206/423 X |
| 5,379,549 | 1/1995 | Carerch et al. | 47/84 |

*Primary Examiner*—Bryon P. Gehman
*Attorney, Agent, or Firm*—Foley & Lardner

[57] ABSTRACT

A shipping box for plants set with soil in pots, in which a plurality of holder panels are positioned in the box in spaced relation. Each panel is formed with a plurality of pairs of entry slots extending vertically upwardly from the bottom of the panel. The entry slots terminate at their upper ends in retaining slots adapted to receive elastic, resilient retainer bands which when expanded are adapted to extend around and thus constrict a potted plant and resiliently bias the plant toward the panel. The plant is thus retained in position during shipping, and its spilling of soil is prevented in the event the box is tipped or tilted.

7 Claims, 3 Drawing Sheets

SHIPPING BOX FOR PLANTS

BACKGROUND OF THE INVENTION

The invention relates as indicated to a shipping box for plants, and relates more particularly to a shipping box capable of being shipped by common carriers with little or no damage to the plants.

The shipment of plants in boxes or containers by common carriers is less than satisfactory for any number of reasons. This is true even with highly reputable carriers such as United Parcel Service. Plants are typically shipped in pots with soil, and a constant concern of those shipping is to make certain that the plants stay properly oriented and are not tipped or tilted so as to cause or potentially cause loss of soil or even the plants from the pots. It will be appreciated that in handling boxes of plants, some of which are relatively large, it is very difficult for common carriers to maintain the boxes in a horizontal position, despite notices or warnings on the top of the box. Entire shipments can be destroyed if the boxes are inadvertently or unintentionally tipped upside down, and substantial damage can occur if the boxes are oriented to the point where substantial soil loss results.

Numerous plant containers have been designed with the above problems in mind. To the best knowledge of the inventor, no one has been able to achieve completely satisfactory results. An acceptable design must meet certain fundamental design criteria. The box must be relatively inexpensive and highly functional. Shipping costs are a substantial factor in the overall pricing of plants, and containers which are comparatively expensive will simply not find universal use. Likewise, if the container, although perhaps inexpensive, is difficult to load with plants, it will likewise not find universal use since loading involves labor costs which are reflected directly in the pricing of the product. Further, the design should be such that if the box is inadvertently tipped over or to one side, the plants and soil do not spill out of the pots. In this regard, the plants are normally set in soil or peat moss, with additives such as perlite or the like, and the overall composition is relatively loosely contained in the pots. This makes the composition very susceptible to spilling, and loss of a substantial part of the soil composition from the pot will obviously result in loss of the plant as well.

A further design disadvantage of present plant containers or boxes is that they are normally not designed to accommodate sleeved pots. At point of sale, potted plants, for example, African Violets, are frequently sold with an enveloping sleeve referred to as UPS (Universal Plant Sleeve). The pots can be dropped down into the sleeve, with the sleeves being substantially longer than the potted plants, even in full bloom. The sleeve is generally cone shaped, opening upwardly and outwardly to accommodate the plant leaves and the blooms. The use of UPS sleeves minimizes leaf breakage during the marketing process, and substantially more plants can be displayed in a particular area since the diameter of the plant is somewhat constricted by the sleeve. The sleeve, which is typically paper but can also be made of plastic film, can also usefully display information concerning the product, or advertising for the product.

SUMMARY OF THE INVENTION

With the above in mind, a primary objective in accordance with the present invention is to provide a relatively inexpensive shipping container but one which is highly functional with respect to locating the plants and preventing loss of soil from the pots in the event the box is tipped or tilted.

A further object of the invention is to provide a shipping container specifically designed to accommodate pots already packaged with a UPS sleeve. In fact, the invention is designed with the sleeved pot specifically in mind, that is, the effect of the sleeve on the plant, and particular the leaves of the plant. The sleeve actually forms part of the system to prevent loss of soil.

A still further objective is to provide a shipping box in which the potted plants can be quickly and easily positioned in spaced location in the container, and retained in such position during the shipping process. When the shipping box is received, the potted plants can be quickly removed from the box and are immediately ready for sale since sleeves were placed around the pots at the time the pots were placed in the box.

The invention more specifically comprises a box having opposed side and end walls, a bottom wall and a cover, and a plurality of holder panels positioned in spaced relation in the box. The panels are positioned generally vertical and extend substantially the full height of the box, being spaced from each other an amount generally equal to the diameter of a pot, or slightly greater. Each panel is formed with a plurality of longitudinally spaced elongated entry slots which extend from the bottom of the panel vertically upwardly a substantial distance, terminating at their upper ends in retaining slots. Each adjacent pair of entry slots are adapted to receive resilient, expandable retainer bands which can be moved upwardly through the entry slots into the retaining slots and be retained therein by virtue of the resilient nature of the bands. In such position, when a sleeved pot is positioned adjacent the holder panel between adjacent entry slots, the retainer band associated therewith can be expanded around the potted plant for retaining the same resiliently bias toward the holder panel. In like manner, sleeved pots can be resiliently retained along the entire length of the panel.

The use of the UPS sleeve pre-packaged with the pot has a further advantage in addition to permitting the plants to be shipped completely ready for sale at the destination. The location of the retaining slots relative to the height of a typical 4" pot is such that the retainer band when expanded horizontally around the potted plant engages slightly above the top rim of the pot, thereby resiliently constricting the UPS sleeve and the plant contained therewithin. This constriction of the plant tends to create a more dense barrier to the passage of loose soil or dirt from the pot in the event the box is tilted or tipped. A further function of the UPS sleeve when made of paper, is that during shipping the plant gives off moisture which is absorbed by the sleeve which actually facilitates more constriction during the shipping process. This ensures an even tighter fit of the retainer band around the plant, but the fit is not sufficiently tight that the plant leaves or stems are damaged. When the sleeve is eventually removed by the customer, the leaves quickly drop into their natural orientation.

A further feature of the invention are locking tabs formed in the holder panel approximately intermediate and at approximately the same height as the retaining slots. The tabs can be punched or stamped in the panel and are adapted to be pivoted from the plane of the panel outwardly to the back or opposite face of the panel. The tabs of each panel when so oriented are adapted to extend over the top edge or lip of pots previously positioned and retained in the adjacent holder panel. Thus, as each holder panel is loaded with pots, the locking tabs can be bent rearwardly so that when the panel is positioned in the box snugly against the previously positioned pots in the adjacent panel, the tabs can fit over the adjacent pot edges and prevent the same from moving vertically in the event the container is tipped or tilted. In this regard, it should be noted that the constriction of the sleeve around the plant above the pot as above described exposes the pot edge for engagement by the adjacent locking tab. Thus, when the container is fully loaded with holder panels and pots resiliently retained on the panels, the locking tabs serve to vertically constrain the pots thereby preventing soil spillage.

A further feature of the invention is the provision of side flanges and a top or cover flange on each holder panel. The holder panel is formed with fold lines to facilitate hinged movement of the top and side flanges. When the holder panel is positioned in the container for loading the potted plants, the side flanges are pivoted inwardly to the front at both sides of the panel, with the flanges when so folded being generally perpendicular to the plane of the holder panel and parallel to the adjacent sides or ends of a container. Each side flange is formed with an end tab which can be further folded to extend in a direction generally parallel to the plane of the holder panel. The dimension of the side flanges is such that the end tab is spaced from the holder panel when so moved that it snugly accommodates the thickness of the pot when mounted on the holder panel. The orientation of the side flanges contiguous the adjacent sides or ends of the container serve to stabilize the holder panel and prevent the plants from rocking back and forth in the box when loaded and shipped.

The top or cover flange is similarly hinged along a fold line at the top of the holder panel thereby permitting the cover flange to be folded downwardly to a position generally parallel to the top and bottom of the box. The cover flange thus overlies the sleeved pots thereby providing increased strength and stability to the panel and preventing the plants from swaying sideways when the plants are loaded and unloaded from the box.

A still further feature of the shipping box comprising the invention is its inexpensive manufacture. The panels can be stamped in their original flat shape, and further stamped or punched to provide the slots and fold lines. The panels are preferably formed from recyclable corrugation paper board, with the corrugations running vertically to provide added strength to the holder panel. The box and holder panels can if necessary be reused, but if discarded the paper board is recyclable. The retaining bands, which can comprise conventional rubber bands, can be reused by the user for many purposes.

These and other objects and features of the invention will be apparent from the following description which proceeds in particular reference to the application drawings.

DETAILED DESCRIPTION OF THE PREFERRED EMBODIMENTS

Figure 1:
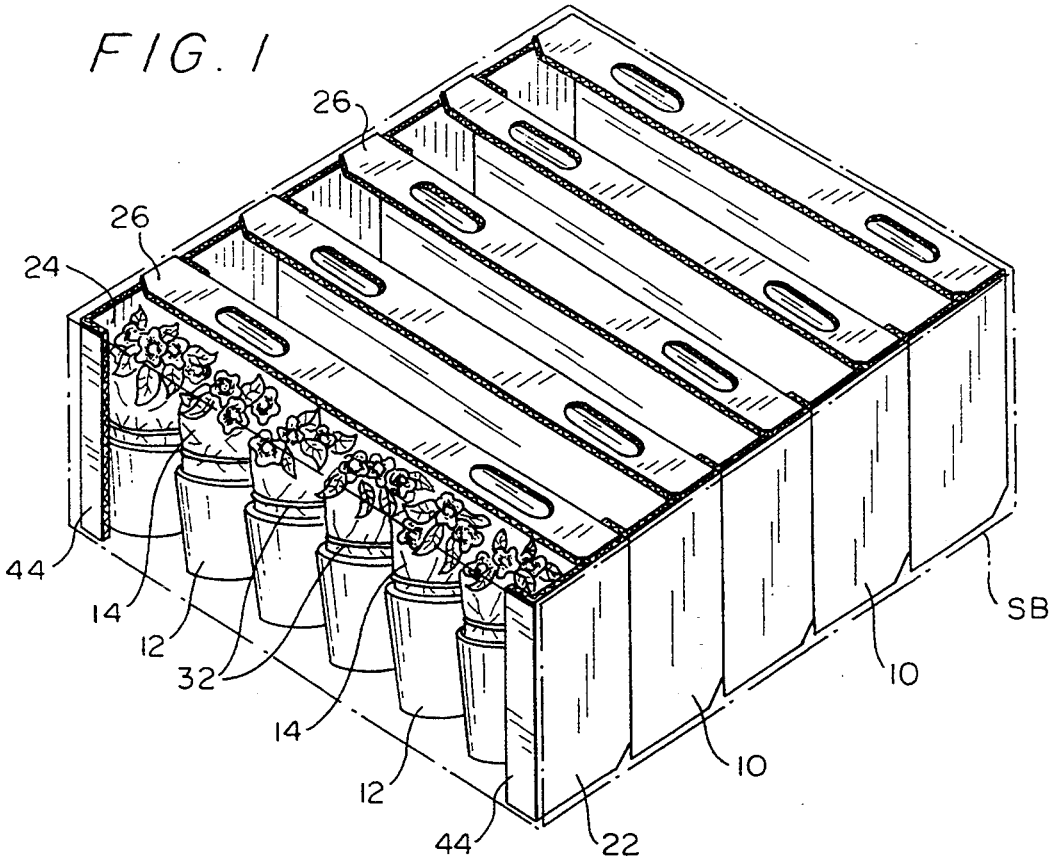
FIG. 1 comprises a top perspective view showing the manner in which a series of holder panels are positioned in a container, with only a single row of plants being illustrated, and the outer box or container being shown in dashed lines for purposes of clarity.
Figure 2:
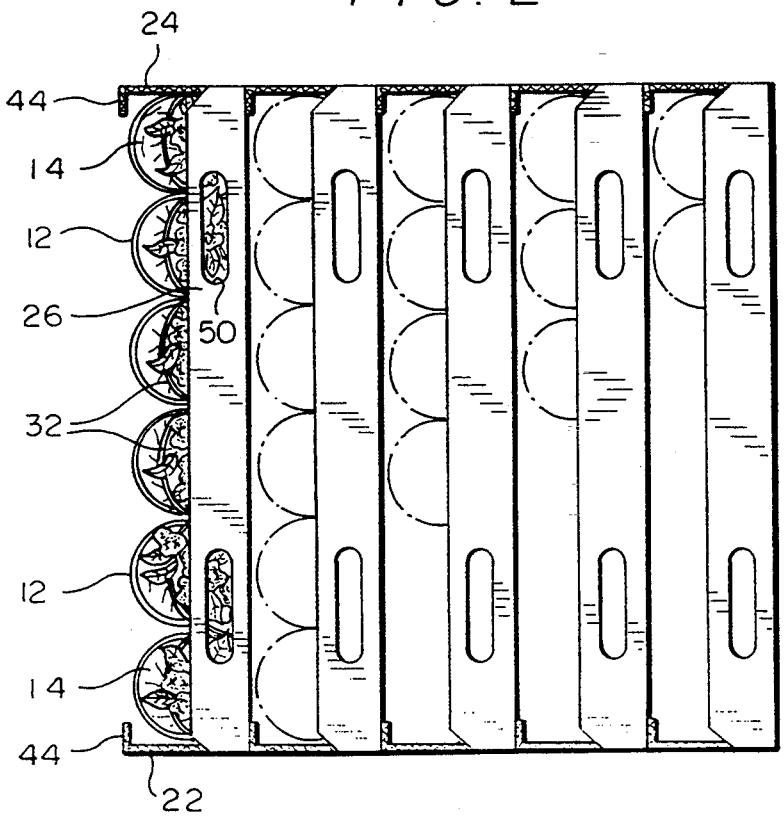
FIG. 2 is a top plan view of FIG. 1.

Referring initially to FIGS. 1 and 2, a shipping box shown in dashed lines at SB for purposes of clarity is adapted to contain a series of holder panels commonly designated at 10. The panels are adapted to be positioned in the box as shown in these figures, and each panel 10 is adapted to have resiliently mounted thereon a plurality of potted and sleeved plants commonly indicated at 12. Each potted plant prior to being mounted on the holder panel is dropped into a sleeve 14 which can comprise, for example, a Universal Plant Sleeve (UPS) preferably made of paper. However, the sleeve can be made of plastic film as well. The sleeve fits over the entire pot and extends upwardly and outwardly above the pot to retain the leaves of the plant and blooms. The diameter of the sleeve in the area thereof just above the top edge of the pot is substantially less than the total diameter of the leaves of the plant as a result of which the leaves are upwardly constricted when the pot is dropped into the sleeve. The dimension of the sleeve and the total diameter of the plant are such that the leaves are not damaged by being constricted in this manner. The leaves quickly will drop into their normal orientation when the potted plant is removed from the sleeve. Depending upon the height of the sleeve and the size of the plant, the sleeve can extend entirely above the flowers of the plant, although in the drawing, again for purposes of clarity and understanding, the top of the sleeve is shown terminating below the top of the plant. The height of the holder panels and the overall shape and height of the outer box SB can be dimensioned to specifically accommodate plants of a particular size and species.

The sleeve 14 generally is formed with a closed or partially opened bottom for receiving the bottom of the pot, and the sides of the sleeve extend upwardly around and tightly envelop the pot. In the application drawings, the top edge of the pot is visible, although it will be understood that the sleeve in actuality hides the top edge of the pot.

Figure 3:
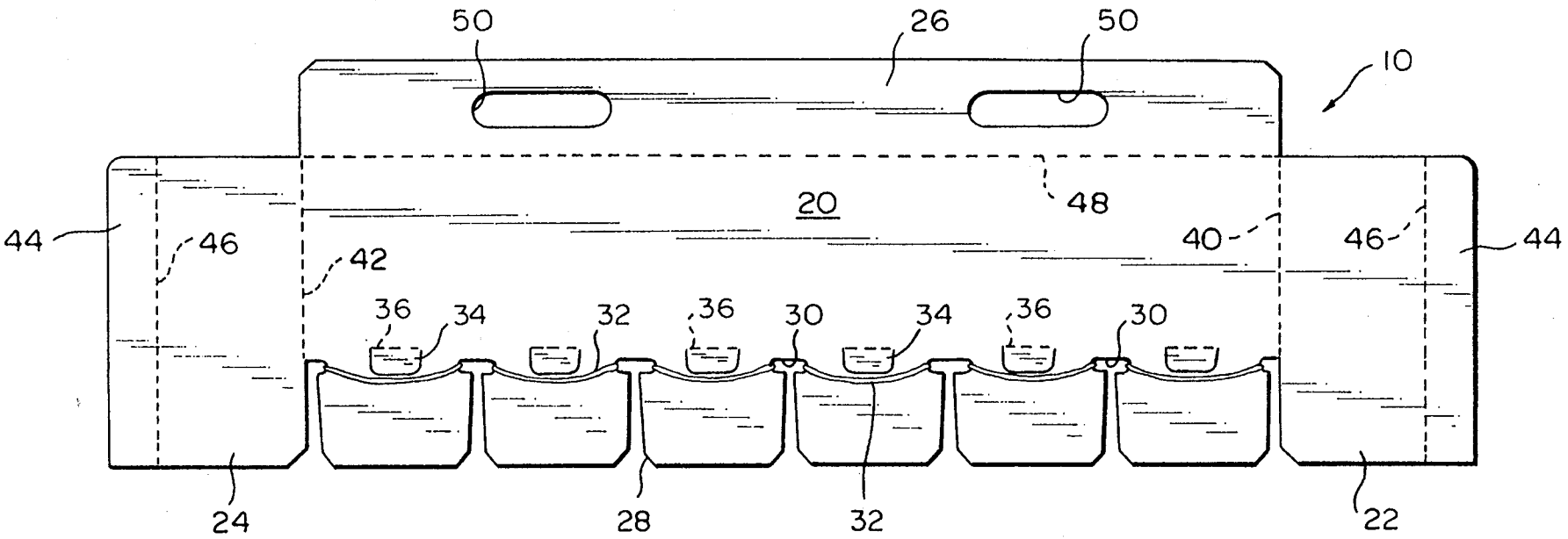
FIG. 3 is a front elevational view showing a holder panel in its initially flat position and before folding into its use position shown in FIGS. 1 and 2.

Referring to FIG. 3, each holder panel 10 comprises a main body 20, side flanges 22 and 24 at each end of the main body, and a top cover or flange 26. A plurality of entry slots commonly designated at 28 are formed in the main body in longitudinally spaced relation. The entry slots 28 communicate with the bottom edge of the main body and are enlarged at the juncture of the bottom edge to facilitate entry of retaining bands in adjacent entry slots as will be hereinafter described.

Each entry slot terminates at its upper end in a generally oval shaped retaining slot 30 the axis of which is generally perpendicular to the axis of the adjacent entry slot. Depending upon the size of the pots to be shipped, the retaining slots can be located at a desired height, and are preferably located slightly above the top edge of the pot as will be described below.

As shown in FIG. 3, retaining bands commonly designated at 32 are positioned in adjacent retaining slots 30. The retaining bands can typically be rubber bands of the requisite diameter and strength, and can be expanded for passage upwardly through the entry slots into resilient engagement with the edges of the retaining slots as shown in FIG. 3. In the form shown, there are six pairs of entry slots and retaining slots, with a retaining band 32 being positioned in each adjacent pair of retaining slots.

Approximately intermediate each pair of retaining slots 30 and approximately at the same elevation are locking tabs commonly designated at 34. These tabs can be punched or perforated from the main body and can be pivoted outwardly or rearwardly of the main body along a pivot or hinged line 36. The tabs are for the purpose of overlying the top edge of pots positioned in the immediately preceding row, as will be described in more detail when particular reference is made to FIGS. 4 and 5.

Side flanges 22 and 24 are hinged to the main body 20 along score lines 40 and 42, respectively, to permit the side flanges to be pivoted to a position generally perpendicular to the main body, as shown in FIGS. 1 and 2. Each side flange is formed with an end tab commonly designated 44 which can be pivoted about the adjacent side flange through a score line commonly designated at 46, to a position generally parallel to the main body and perpendicular to the side flange, again as shown in FIGS. 1 and 2. When so folded, the side flanges are adapted to relatively snugly receive the sides of the outer container or shipping box SB, with the end tabs 44 effectively providing a positioning point for the holder panel next to be positioned in the container. As can be seen in FIGS. 1 and 2, the width of the side flanges is approximately the same or slightly greater than the diameter of the pot at the top edge thereof, so that the pots are snugly positioned between adjacent holder panels.

The main body 20 and the side flanges 22 and 24 when bent to their perpendicular position as shown in FIG. 1, provide a very stable mounting for the plants. The side flanges are positioned contiguous the side walls of the outer container and serve to prevent the plants from rocking back and forth in the box when loaded and during shipment.

The top cover or flange 26 of the holder panel is hinged to the main body 20 along score line 48 and can be folded downwardly to a generally horizontal position perpendicular to the main body, as shown in FIGS. 1 and 2, and is formed with openings commonly designated at 50 to facilitate handling of the holder panel. The top cover 26 provides added strength and rigidity to the holder panel and also functions as a top barrier and protector for the plants when the top of the outer container or shipping box is closed and sealed. In addition, when the top of the plants or sleeve lie closely adjacent the top cover 26, the cover serves the additional function of preventing the plants from shifting sideways.

The shipping box SB is loaded sequentially from front to back, or from left to right as shown in FIG. 2. The cover of the outer box SB is removed to expose the interior, and the holder panel is folded so at least the side flanges are moved perpendicular to the main body to properly position the panel in the box. The plants are then loaded by expanding each retaining band around the bottom of the potted and sleeved plants, and lowering the plant for support on the bottom of the shipping box. The retaining band is then released, and it will be noted from FIGS. 4 and 5 that it engages the plant around the sleeve at a location slightly above the top edge 60 of the pot. As a result, the retaining band constricts the plant in such area. This constriction serves to reduce the diameter of the plant in such area, without, however, causing any damage to the plant. However, importantly, the constricting of the plant stems slightly above the pot provide a more dense barrier in that area thereby inhibiting the passage of loose soil through such area. Thus, in the event the box is tipped or tilted during loading or shipment, the constricting of the plant and sleeve above the top edge of the pot substantially reduces the potential of soil loss upwardly from the pot through such area. Such restriction can be safely carried out completely without damage to the plant, the leaves of which quickly assume their normal orientation after unloading and removing the sleeve from around the plant.

A further advantage of the invention where a paper sleeve is used is that during shipment moisture is given off from the plant and absorbed by the paper sleeve. The paper sleeve when moist allows the retaining band to constrict even more around the plant, ensuring an even tighter fit and further inhibiting loss of soil, again without damaging the plant in any manner.

Figure 4:
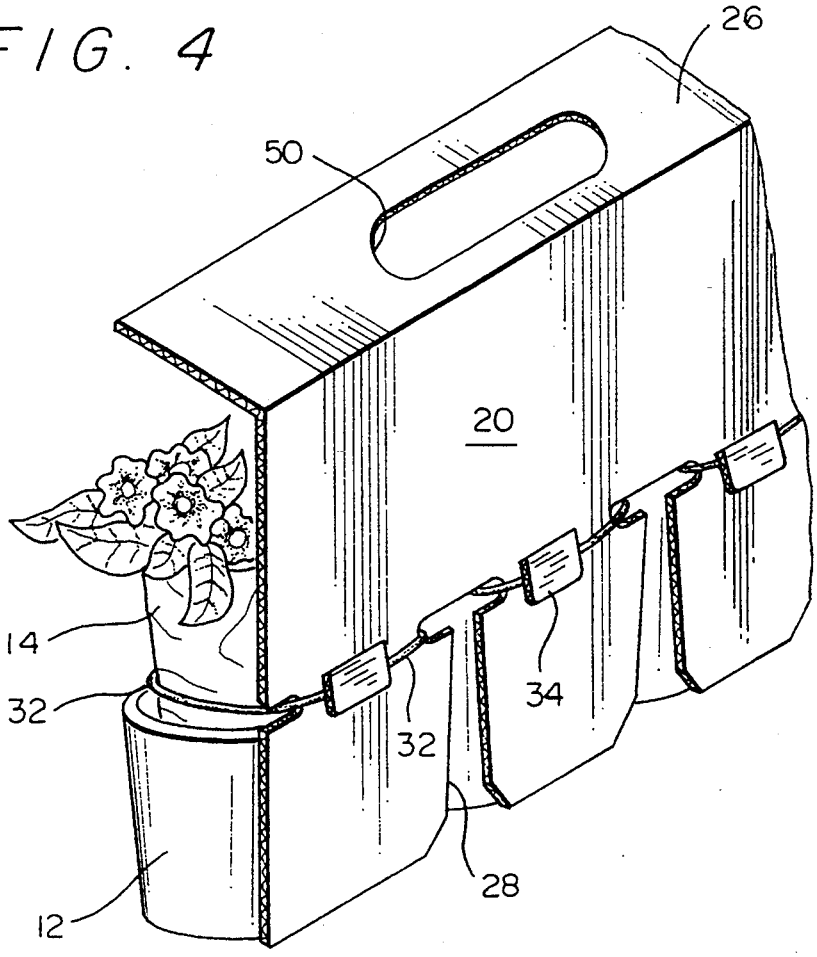
FIG. 4 is a partially fragmentary, rear perspective view looking toward the back surface of part of a holder panel, with a potted plant being shown retained on the panel by a retaining band.
Figure 5:
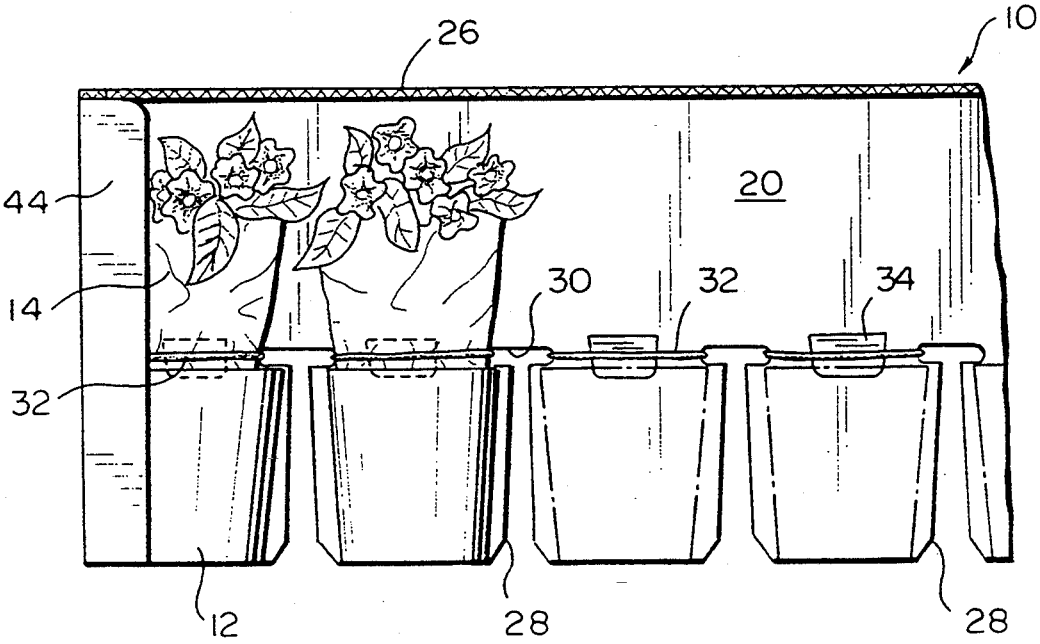
FIG. 5 is a partially fragmentary front elevational view of the holder panel, showing two potted plants retained on the front face or surface of the panel.

As can be seen in FIG. 4, the locking tabs 34 can be punched out rearwardly of the main body of the holder panel and are adapted to engage over the top edge of aligned pots in the rearwardly adjacent row. As can be seen in FIG. 5, the bottom edge of each locking tab 34 extends below the top edge of the adjacent pots. Thus, before inserting the next holder panel in position after the preceding row has been filled, the locking tabs 34 can be punched outwardly or rearwardly and positioned over the edges of pots in the preceding row. The side flanges can then be folded perpendicular to the main body to maintain the next holder panel in position for loading. Once so positioned, the sleeved and potted plants can be mounted on that panel as described, without interfering with or disrupting the engagement of the locking tabs over the previously mounted row of pots.

When the entire box has been filled as shown in FIG. 1, it will be seen that a snug fit is maintained in all directions. The pots engage the bottom wall of the box SB, and the engagement of the side flanges 22 and 24, and the cover flanges 26, with the side walls and top of the box SB results in minimal shifting of the holder panels in the box during shipment. If shifting and even tilting or tipping is encountered, the novel resilient mount for the sleeved pot is such that the spilling of soil is minimized to the extent possible.

At the destination, the sleeved pots can be quickly removed from the holder panel by simply stretching each retaining band and grasping the pot and moving the same upwardly away from the retaining band. The sleeves can be retained in place during marketing since the consumer is able to totally see the condition of the plant and the flower color. If the shipping box and holder panels are to be reused, the bands can be retained in slot 30 following removal of the pots. If the shipping box is not to be reused, the retaining bands can be removed if desired, and the paperboard outer box and holder panels are recyclable thereby reducing environmental waste.

The holder panels are preferably of paperboard, corrugated in a vertical direction. This provides increased strength in such direction which not only enhances the holder panel when used as described but also permits stacking of loaded shipping boxes one upon the other during shipping, without damaging the lower boxes.

In the form shown, the holder panels are dimensioned to accommodate six potted and sleeved plants, and the shipping box SB as shown in FIGS. 1 and 2 is adapted to receive five holder panels when the side flanges and top covers are folded as shown in those figures. The side flanges of the several panels are contiguous and aligned, thereby providing stability at both sides of the panel during shipping. The end tabs 44 and top covers 26 provide further stability to the holders when so positioned, thereby minimizing rocking or tilting movement of the plants during shipping.

The invention is highly adaptable to specialize shipping needs based on the unique requirements of particular plants. The dimensions of the outer shipping box and holder panels can be varied as desired. Many more or fewer plants than the six shown can be mounted longitudinally on each panel, and the overall height of each panel can be changed to accommodate varying heights of different plants to be shipped. The spacing between panels can be varied by changing the width of the side flanges, and the width of the cover flanges can likewise be varied to provide more or less top coverage than shown in the application drawings.

The holder panels can be inexpensively manufactured by conventional stamping and punching operations, and the size and location of the various slots and openings can be varied as desired to best accommodate the plants being shipped. For example, the distance between the entry slots can be varied to accommodate varying pot sizes, and the vertical location of the retaining slots 30 can be likewise located at the optimum height. Although the retaining bands in the form illustrated and described comprise conventional elastic rubber bands, other forms of elastic bands can likewise be utilized. Moreover, an elastic strip rather than a band could be provided, although in such event each end of the strip would need to be secured to the holder panel.

It will be apparent to those skilled in the art that minor modifications can be made to the invention as illustrated and described without, however, departing from the spirit or concepts of the invention, and without departing from the scope of the appended claims.

What is claimed is:

1. A shipping box for plants set with soil in pots, comprising:

a. a box having opposed side and end walls, a bottom wall and a cover;

b. a plurality of holder panels positioned in said box in spaced relation, said panels when positioned generally vertically in said box extending generally from side to side and front to back in the box and extending vertically substantially the full height of the box, each panel being formed with a plurality of longitudinally spaced elongated entry slots extending vertically upwardly from the bottom of the panel, said entry slots being open at the bottom of said panel and terminating at their upper ends in retaining slots, and c. expandable, resilient retainer bands positioned in adjacent retaining slots and extending on both sides of each said panel, each of said bands when expanded on one side of each said panel being adapted to extend around and constrict a potted plant and resiliently bias the potted plant toward said panel, thereby retaining the potted plant in position during shipping and preventing spilling of soil when the box is oriented other than horizontally.

2. The shipping box of claim 1, wherein each of said holder panels is formed with side flanges which are folded to extend in a direction generally perpendicular to the plane of the panel, with the panel and side flanges being dimensioned so that the side flanges are adjacent the sides of the shipping box, with each side flange being formed with an end tab which can be folded to extend inwardly of the box in a plane generally parallel to the plane of the holder panel, said end tab being spaced from the plane of the holder panel an amount to accommodate a potted plant.

3. The shipping box of claim 1, wherein each of said holder panels is formed with a cover flange which is foldable downwardly to a generally horizontal position perpendicular to the plane of the holder panel, said cover flange when folded functioning as a barrier preventing vertical movement of sleeved pots mounted on the holder panel.

4. The shipping box of claim 1, further including a plurality of locking tabs formed in each holder panel generally intermediate each pair of retaining slots, said locking tabs being adapted to be pivoted rearwardly of each said holder panel to engage over a top edge of pots positioned on the rearwardly adjacent holder panel thereby preventing vertical movement of the pots.

5. The shipping box of claim 4 wherein said holder panels are formed of paper board having corrugations, with said corrugations extending vertically to provide rigidity and strength to the holder panel.

6. The shipping box of claim 1, further including a pot containing soil and a plant, said pot having a top edge wherein said retaining slots are formed in each said holder panel at a position slightly above said top edge of said pot when said pot is mounted on said holder panel by said retaining band, one of said retaining bands when expanded extending around the potted plant slightly above said top edge of said pot thereby constricting the potted plant in the area above said top edge of said pot, thereby inhibiting the spillage of soil from the pot.

7. The shipping box of claim 1 further including a pot containing soil and a plant, and a sleeve extending around a pot and enveloping the plant, one of said retaining bands when the pot is mounted on the holder panel engaging around the sleeve above a top edge of the pot thereby constricting the sleeve and the plant in the area above said top edge, such constriction inhibiting the spilling of soil from the pot.

* * * * *